US008430772B1

(12) United States Patent
Jones

(10) Patent No.: US 8,430,772 B1
(45) Date of Patent: Apr. 30, 2013

(54) GAME TABLE

(76) Inventor: Jamie Lee Jones, Manson, WA (US)

( * ) Notice: Subject to any disclaimer, the term of this patent is extended or adjusted under 35 U.S.C. 154(b) by 0 days.

(21) Appl. No.: 13/570,131

(22) Filed: Aug. 8, 2012

(51) Int. Cl.
*A63B 67/04* (2006.01)

(52) U.S. Cl.
USPC ..... 473/490; 473/491; 473/496

(58) Field of Classification Search ..... 473/490–492, 473/494, 496; 273/108, 118 R, 118 A, 119 R, 273/119 A, 123 R, 123 A, 126 R, 126 A, 273/127 R, 127 B, 342, 353, 309
See application file for complete search history.

(56) References Cited

U.S. PATENT DOCUMENTS

| | | | | | |
|---|---|---|---|---|---|
| 464,098 | A | * | 12/1891 | Harr | 273/337 |
| 970,257 | A | * | 9/1910 | McDonald et al. | 273/123 R |
| 1,186,620 | A | * | 6/1916 | Titus | 273/342 |
| 1,512,985 | A | * | 10/1924 | Houldsworth | 273/119 R |
| 1,564,863 | A | * | 12/1925 | Laing | 273/409 |
| 1,622,156 | A | * | 3/1927 | Kornahrens | 273/119 R |
| 1,930,973 | A | * | 10/1933 | Gross | 273/125 R |
| 1,962,576 | A | * | 6/1934 | Von Stackelberg | 273/126 R |
| 2,147,502 | A | * | 2/1939 | Savage | 473/588 |
| 2,301,265 | A | * | 11/1942 | Fandrey | 273/400 |
| 2,450,613 | A | * | 10/1948 | Radinsky | 273/122 R |
| 2,657,056 | A | * | 10/1953 | Sorteberg | 473/410 |
| 2,943,858 | A | * | 7/1960 | Slater | 273/118 R |
| 3,452,985 | A | | 7/1969 | D'Zmura | |
| 3,643,954 | A | * | 2/1972 | Meyer et al. | 273/119 A |
| 3,647,216 | A | * | 3/1972 | Breslow | 273/123 R |
| 3,819,182 | A | * | 6/1974 | Lersch | 273/342 |
| 3,927,884 | A | * | 12/1975 | Glass et al. | 273/119 R |
| 4,061,334 | A | * | 12/1977 | Kanno | 273/126 A |
| 4,108,434 | A | | 8/1978 | Royer | |
| D254,018 | S | | 1/1980 | Malm | |
| 4,335,877 | A | | 6/1982 | Long | |
| 4,445,690 | A | * | 5/1984 | Cairns | 273/118 R |
| 4,522,395 | A | | 6/1985 | Arndt | |
| 4,726,592 | A | * | 2/1988 | Callaham | 273/342 |
| 4,775,152 | A | * | 10/1988 | Roehl | 273/108.1 |
| 5,139,259 | A | * | 8/1992 | Yeakley | 273/118 A |
| 5,207,432 | A | | 5/1993 | Miller | |
| 5,282,635 | A | * | 2/1994 | Hopkins | 273/342 |
| 6,131,905 | A | * | 10/2000 | Christian | 273/126 A |
| 6,840,515 | B2 | * | 1/2005 | Seme | 273/118 R |
| 7,063,324 | B2 | * | 6/2006 | Kelley et al. | 273/317 |
| 7,338,047 | B2 | * | 3/2008 | Kelley et al. | 273/317 |
| 7,367,907 | B1 | | 5/2008 | Sutton | |
| 7,637,827 | B2 | | 12/2009 | Bangerter | |
| 7,727,091 | B2 | | 6/2010 | Allen | |
| 2004/0005941 | A1 | | 1/2004 | Chen | |
| 2005/0012266 | A1 | * | 1/2005 | Kelley et al. | 273/118 R |
| 2006/0108733 | A1 | * | 5/2006 | Kelley et al. | 273/118 R |

FOREIGN PATENT DOCUMENTS

| | | | |
|---|---|---|---|
| FR | 2 794 658 | A1 | 12/2000 |
| JP | 10-295865 | A | 11/1998 |

* cited by examiner

*Primary Examiner* — Raleigh W. Chiu
(74) *Attorney, Agent, or Firm* — Christensen O'Connor Johnson Kindness PLLC

(57) ABSTRACT

A game table (12) includes a table top (14) constructed from four truncated triangular sections (24) and a center section (26). The table top is supported by an underlying frame (26) and table legs (18). A central landing zone (20) is defined on the table top by a perimeter boundary (80). The perimeter boundary is formed by netting, extending between corner posts (84).

16 Claims, 7 Drawing Sheets

GAME TABLE

TECHNICAL FIELD

The present application pertains to game tables, and more particularly to game tables for playing a service-and-return game with a ball.

BACKGROUND

Numerous service-and-return games have been played on a table or other surface by two or more players. Typically in these games, a ball or other projectile is struck with a paddle, with the player's hand, with a bat, etc., to direct the ball to different playing zones.

Perhaps one of the best known type of table top service-and-return games is table tennis. In table tennis, a racquet is used to strike a ball back and forth over a net that extends centrally across the width of a rectangular shaped table. Table tennis is primarily a two-person game, although at times the game is played in a "doubles" format, with teams of two players. Also in table tennis, it is difficult for handicapped persons or persons confined to a wheelchair to play the game.

The present disclosure provides a novel game table enabling a service-and-return game to be played by more than two persons simultaneously. Also, the disclosed game table enables the service-and-return game to be played by persons confined to a wheelchair, while taking up less floor space than required by a regulation table tennis table.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A service-and-return game table is provided composed of a table top having a continuous, planar, top surface and an enclosed landing zone positioned on the table top into which the game ball or other projectile is to be hit during each legal service or return of the game ball. This landing zone, also termed the "bounce area" is defined at least in part by a perimeter boundary extending around the landing zone. Such perimeter boundary extends upwardly from the top surface of the table top. However, the table top is otherwise free from any structural elements or features extending upwardly therefrom. The landing zone is typically substantially smaller than the total area of the table top, making it a challenge for game players to always place the ball into the landing zone when serving the ball or returning the ball.

In a further aspect of the present disclosure, an underlying frame is provided to support the table top. However, if the table top is of a molded construction, the underlying frame portion may be integrally formed with the underside of the table top. Also, legs can be provided for supporting the table top at a desired elevation above the floor.

In accordance with a further aspect of the present invention, the underlying frame may be composed of components that can be assembled or disassembled into elongated members.

In further aspects of the present disclosure, the table top can be of various shapes, for example, triangular, square, rectilinear, rectangular, pentagonal, hexagonal, octagonal, round, oval, elliptical, etc. Further, the landing zone in shape can correspond to the shape of the table top or could be of a shape different from that of the table top. Moreover, the landing zone can be positioned centrally on the table top, or positioned off-center from the table top.

The table top can be divided into "playing zones" wherein the opponent must place the ball, after bouncing the ball in the landing zone, into the opposing player's playing zone.

In accordance with the further aspects of the present invention, the table top can be composed of segments joined together to form a continuous table top. The interfaces of adjacent segments may define the boundaries of the playing zones located on the table top.

In accordance with further aspects of the present invention, the landing zone is defined by a perimeter boundary extending around the landing zone. Such perimeter boundary can be defined by a net extending along the perimeter boundary. Alternatively, light beams can extend along the perimeter boundary of the landing zone. Still alternatively, a rigid barrier can extend along the perimeter boundary of the landing zone.

In accordance with an additional aspect of the present invention, bumpers can extend along opposite sides of the table top so as to define an abutment along the sides of the table top to help maintain the game ball on the table top even when hit to one side of the table top. The bumpers can include a sloped abutment face extending upwardly from the table top and outwardly toward the adjacent side edge of the table top. The angle of the abutment face assists in keeping a struck ball within the confines of the table top.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
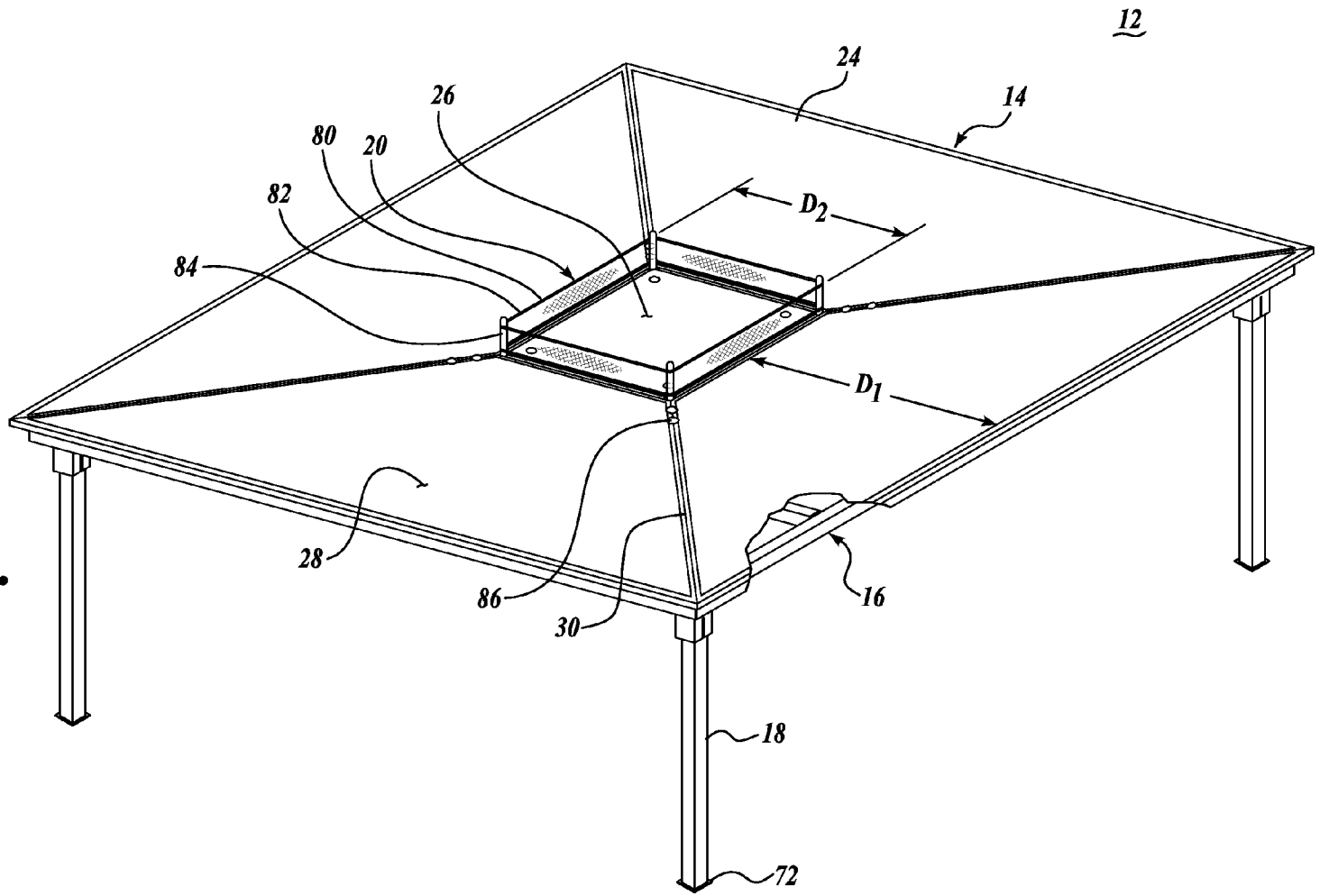
FIG. 1 is an isometric view of a first embodiment of the present disclosure.
Figure 4:
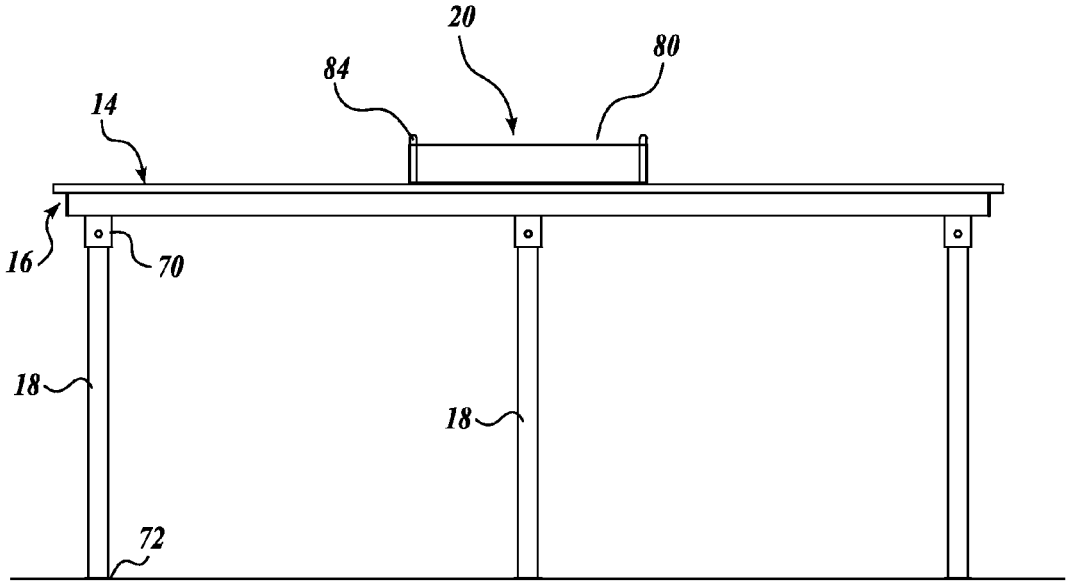
FIG. 4 is a side elevational view of FIG. 1.
Figure 5:
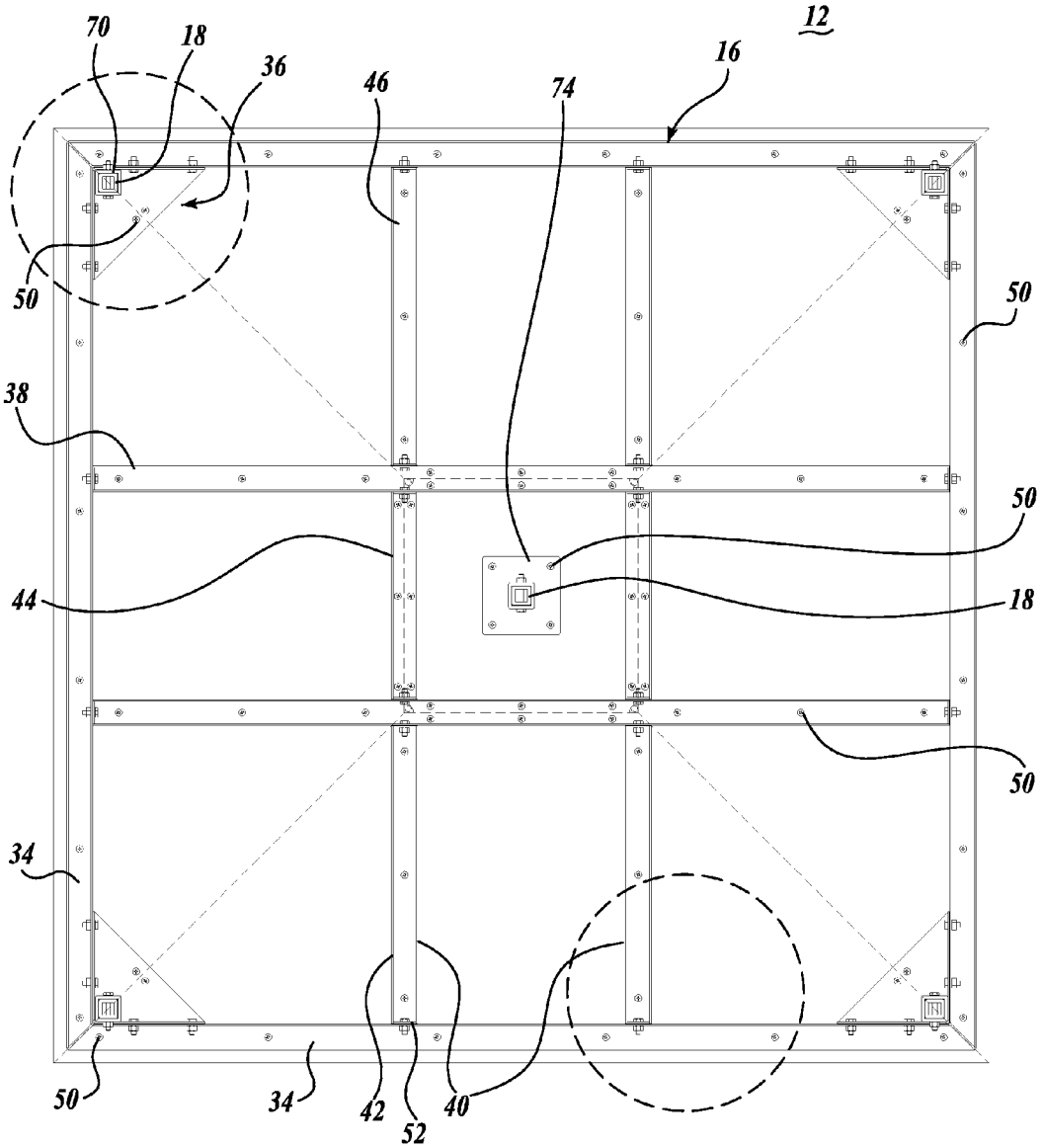
FIG. 5 is a bottom view of FIGS. 1, 2, and 3, showing the construction of the underlying frame.

A game table 12 constructed in accordance with the present disclosure is shown in FIGS. 1, 4 and 5. The table 12 includes a table top 14 supported by an underlying frame 16, see also FIGS. 6 and 7. Support legs 18 extend downwardly from frame 16 to support the game table above the floor. In addition, an enclosed landing zone or bounce area 20 is positioned on the table top 14. These major components of the game table are described more fully below. Also, the following description will illustrate that the game table 12 is constructed from components that may be assembled to form the game table, but with the advantage of being able to ship the game table in disassembled form in a compact configuration.

The table top 14 is illustrated as being substantially square in shape, and composed of four truncated rectangular sections 24 that define the outer perimeter of the table top and a central section 26. By this construction, the table top can fit within a packaging box of a width corresponding to dimension "$D_1$" shown in FIG. 1. Of course, the table top can be constructed from sections of shapes other than the truncated triangular shapes 24 shown in FIG. 1.

The table top can be constructed from numerous different materials, such as wood of various compositions, metallic material, plastic material, fiberglass material, carbon fiber material, etc. In addition, the table top 14 can be in shapes other than shown in FIG. 1. Such other shapes may be, for example, triangular, rectilinear, rectangular, pentagonal, hexagonal, octagonal, round, oval, elliptical, etc. In addition, the shape of the table top need not be one of these specific geometric shapes, but can be irregular in shape. Regardless of the shape of the table top, the table top can still be composed of a plurality of sections thereby to enable the game table to be shipped in a compact configuration.

As shown in FIG. 1, the intersections of the four table top sections 24 can function as borders to divide the table top 14 into four playing areas or sections 28. The borders 30 for these playing sections are defined by the juncture of adjacent playing section 28. As a visual aid, a border or stripe can be painted or otherwise applied along the edges of the playing sections 28 so that the borders 30 visually stand out. It is, however, desirable that except for defining the perimeter of the landing zone or bounce area 20, the top surface of the table top 14 be substantially continuous, and without any impediments or features that would inhibit or misdirect a ball that might land on the border 30, since such ball would be "in play."

Figure 6:
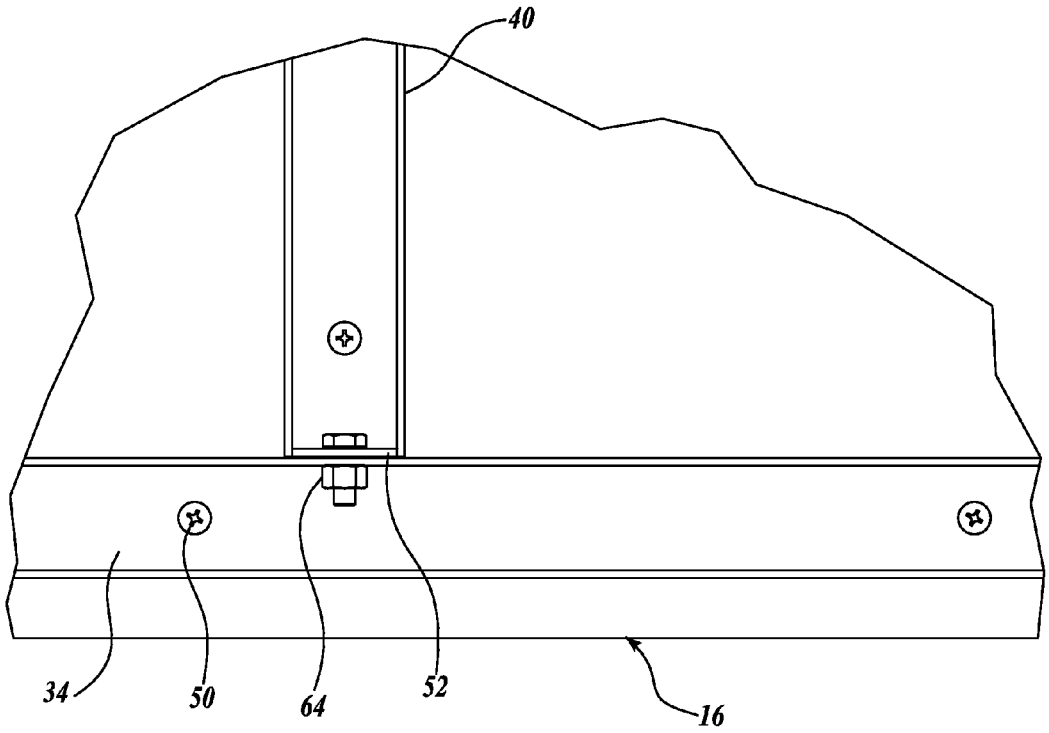
FIG. 6 is an enlarged fragmentary view of FIG. 5 showing the construction of the underlying frame at one corner thereof.
Figure 7:
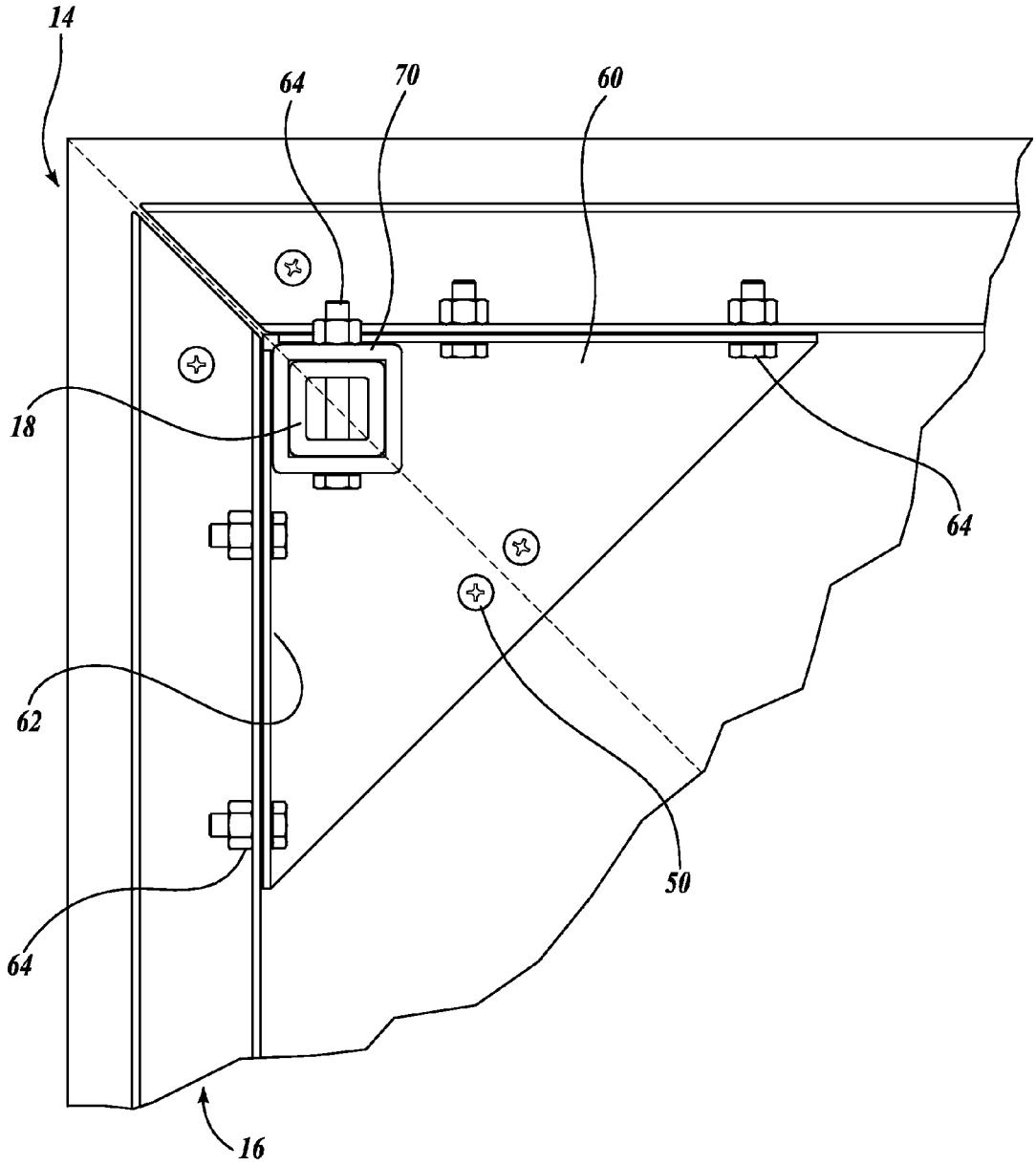
FIG. 7 is a further enlarged fragmentary view of FIG. 5 showing additional aspects of the construction of the underlying frame at one corner thereof.

Referring additionally to FIGS. 6 and 7, the table top 14 is supported by an underlying frame structure 16. However, it would be appreciated that if the table top 14 is constructed from molded material, for example, a high strength or reinforced plastic, reinforced fiberglass, etc., the underside of the table top sections could be constructed with integral webbing, flanges, etc., thereby to provide adequate strength to the table top sections without the need for a separate frame, such as frame 16. However, if the table top 14 is constructed from a wood material, plastic or metallic sheeting or other types of sheet material, then an underlying frame, such as frame 16, would provide additional structural integrity and support for the game table.

As shown in FIGS. 6 and 7, the frame 16 is of lattice type construction consisting of perimeter sections or rails 34 extending along the underside margins of table top 14. The ends of the rail 34 are connected together via corner brackets 36, discussed more fully below. The lattice structure of frame 16 also includes a pair of parallel full-length crossbeams 38 that span across the underside of table top 14 and are connected at their ends to corresponding perimeter rails 34. The second set of segmented crossbeams 40 extend transversely to crossbeams 38 to span across the underside of table top 14. The crossbeams 40 are constructed in three segments, a first end segment 42, a center segment 44, and a second end segment 46. The segments are attached at their ends to adjacent perimeter rails 34 or crossbeams 38. Moreover, each of the perimeter rails 34, corner brackets 36, crossbeams 38, and crossbeams 40 are attached to the underside of table top 14 through hardware members 50 that extend through clearance openings formed in these frame components to extend into the underside of the table top sections 24 and 26.

The perimeter rails 34, crossbeams 38, and crossbeam segments 42, 44, and 46 can be constructed of various structural components, including channel stock, as shown in FIG. 6, but also tube stock, angle stock, flat stock, etc. The channel stock shown in FIG. 6 used to construct the frame 16 is positioned so that the web sections of the channel stock are placed against the underside of table top 14 so that such channel stock is open in the downward direction. This facilitates attaching the frame 16 to the underside of the table top since the hardware members 50 only need pass through the thickness of the web section of the channel stock. Also, using channel stock facilitates the interconnection of the crossbeams 38 and crossbeam sections 42, 44, and 46. In this regard, end caps 52 are welded or otherwise attached to the end of each crossbeam 38 and crossbeam sections 42, 44, and 46. Clearance openings are formed in the end caps to accept hardware members 52 that extend through the end caps and also through corresponding openings formed in the flange portions of the perimeter rails 34 and crossbeams 38 to mate with nuts or other connector members when the frame 16 is being assembled. Of course, other techniques and systems may be utilized to attach the components of the frame 16 together.

Corner bracket 36, as illustrated in FIGS. 6 and 7, includes a triangular plate portion 60 and flange sections 62 extending along the right angle sides of the plate portion 66. The flange portions 62 extend transversely to the plate portion 60 to mate against the corresponding flange portions of the perimeter rails 34. Hardware members 64 extend through aligned clearance openings formed in the bracket flanges 62 and perimeter rail flanges, thereby to securely connect the corner brackets 36 to the end portions of the perimeter rails 34. As noted above, the corner brackets 36 are fastened to the underside of table top 14 by hardware members 50. The corner brackets 36 may be constructed from any suitable material. Moreover, such corner brackets may be of other configurations and still perform the required function of the corner brackets.

A socket 70, shown in square cross-section, extends transversely to the plane of bracket plate 60 at the right angle corner defined by the intersection of the bracket flanges 62. A socket 70 is sized to receive the upper end portions of table legs 18. Cross-holes are formed in the socket 70 to receive hardware members 71, used to attach the upper end portions of legs 18 to the socket 70. The legs 18 are shown in FIG. 1 as one piece, straight legs of square cross-section. Legs 18, and thus also socket 70, may be of other cross-sectional shapes, such as round, rectangular, oval, etc. An end cap 72 is engaged with the bottom ends of the legs 18. End caps may be composed of skid-resistant material. Alternatively, rollers or wheels, not shown, may be fitted to the bottom ends of legs 18 to facilitate moving of the game table as needed. Of course, such rollers or wheels may advantageously include a braking system to be engaged when the game table is in use.

As noted above, legs 18 are illustrated as a unitary member extending the full distance from the bottom of table top 14 to the floor. However, the legs 18 can be of other constructions. For example, the legs can be constructed to telescope, thereby enabling the game table 12 to be raised or lowered relative to the floor. In this manner, the game table may be adjusted to optimal height for players who are sitting rather than standing. Moreover, the game table height may be adjusted to the heights of the game players, lower for children and higher for adults.

A fifth leg 18 may be positioned at or near the center of the game table 12, as shown in FIG. 6. Leg 18 is attached to a sole plate 74 which is in turn attachable to the underside of table top center section 26 through the use of hardware members 50. Of course, legs 18 can be placed at other locations about the table top 14', especially if a table top is shaped other than as shown in FIG. 1 or is of a significantly larger size than shown in FIG. 1.

The landing zone or bounce area 20 is defined on the game table 12 by a perimeter boundary 80 in the form of netting 82 supported by end posts 84. The posts 84 may be insertable into blind holes 86 formed in the table top. The landing zone/bounce area 20 shown in FIG. 1 corresponds to the area of the table top central section 26. However, this does not need to be the case. Rather, the size of the landing zone/bounce area 20 may be smaller than or larger than or a different shape than the table top center section 26. Also, the landing zone/bounce area 20 is shown as being square in shape as is the shape of game table 12. However, the landing zone/bounce area can be other shapes, if desired, perhaps corresponding to the other possible shapes of table top 14 as noted above. The netting 82 extends upwardly from the top surface of table top 14 to a desired elevation, with the height perhaps determined by the level of difficulty desired for hitting a ball into the landing zone by the person returning a serve or during volleying.

Also, the landing zone/bounce area 20 is shown as positioned centrally relative to the table top 14. However, this does not have to be the case. Rather, the landing zone/bounce area can be positioned elsewhere on the table top 14. Moreover, a single landing zone/bounce area 20 is illustrated. However, more than one landing zone/bounce area may be utilized, especially if the game table is shaped differently than as shown in FIG. 1, perhaps the rectangular, oval or elliptical shaped game table.

As shown in FIG. 1, the landing zone/bounce area 20 is of a size substantially less than the size of the game table 12 itself. Dimensionally, in FIG. 1, the length/width of the landing zone/bounce area 20 is illustrated as being about 25% of the overall length/width of the table top 14. This proportion of the landing zone/bounce area width/length relative to the table top width/length can be changed, for example, such proportion could be reduced to 20% or increased to 40% or even higher, thereby to reduce the difficulty or increase the difficulty of using the game table for playing a service-and-return game, as discussed more fully below. The size of the landing zone/bounce area 20 can be easily altered by providing netting 82 of different lengths and providing a series of openings 86 in the top surface of table top 14 for reception of posts 84.

Figure 2:
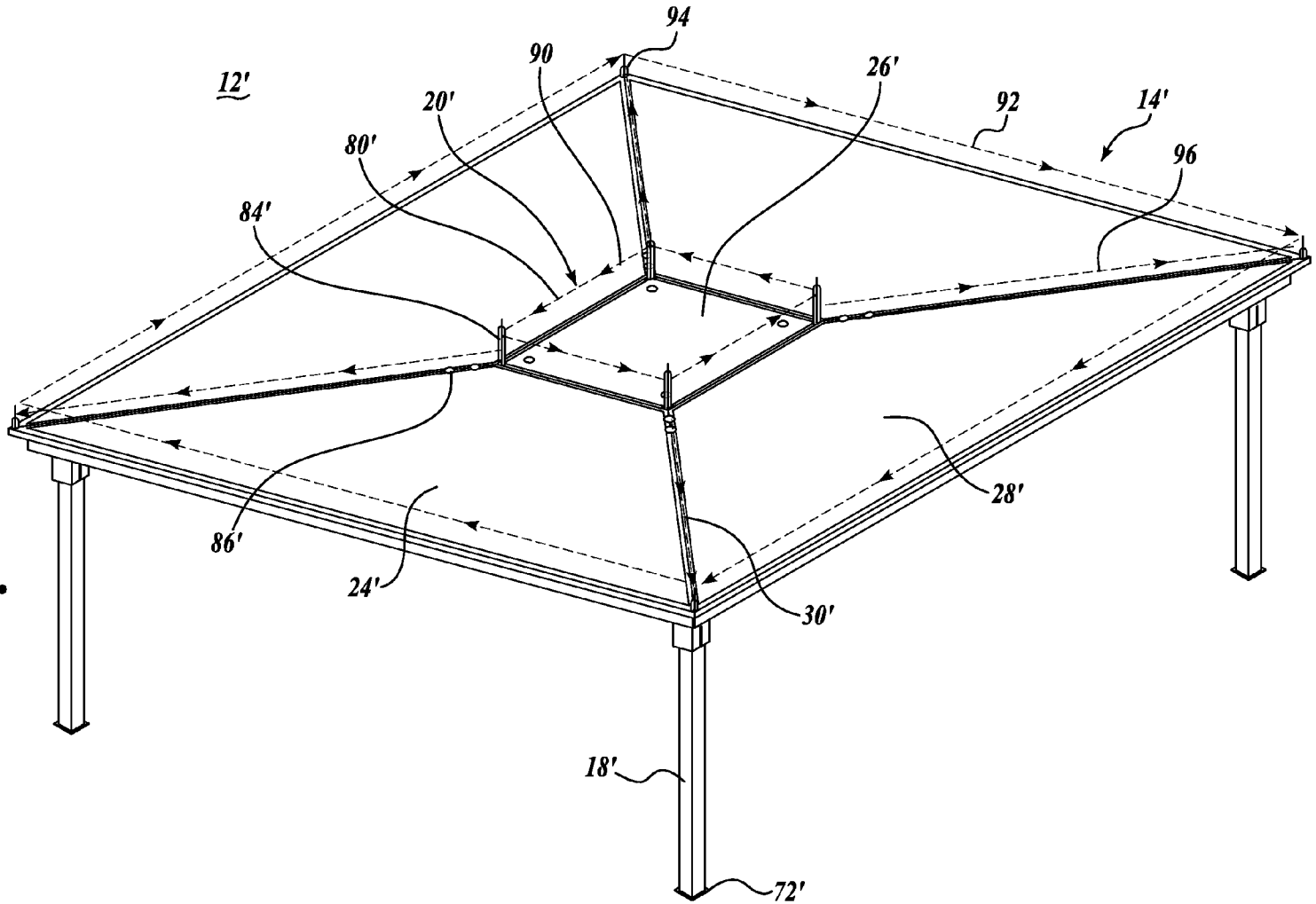
FIG. 2 is an isometric view of a second embodiment of the present disclosure.

The perimeter boundary 80 is shown in FIG. 1 as defined by netting 82. However, other means may be provided for establishing the perimeter boundary. For example, as shown in FIG. 2, the perimeter boundary 80' may be defined by light beams 90 that extend between the posts 84'. The light beams 90 may be generated by a laser system or an electric eye system, which are well-known articles of commerce. An audible sound can be generated if the playing ball interrupts the light beam 90. This occurrence can be the same as a "dead" ball.

In addition to defining the perimeter boundary 80', light beams can also be used to define playing sections 28' on the table top 14', see FIG. 2. In this regard, light beams 92 can extend between the corners of the table top 14. Such light beam may project from corner posts 94 positioned at each of the corners of the table top 14'. Also, light beams 96 can extend between the corners of the table top and the corners of the perimeter boundary 80'. The light beams 96 can extend between corner posts 94 and perimeter boundary posts 84'.

Although not illustrated, the perimeter boundary 80 may be defined by means additionally to those shown in FIGS. 1 and 2. For example, the rigid or semi-rigid fence structure, not shown, could be used to define the perimeter boundary. Such fence structure could be of lattice work design, composed of parallel rails, composed of a solid structure, etc. In addition, such alternative means for creating the perimeter boundary may also be adapted to be readily changed in size and/or shape as desired by the game players. Such alternative structures may include pegs that extend downwardly therefrom to engage within the openings 86 formed in game table top 14.

Figure 3:
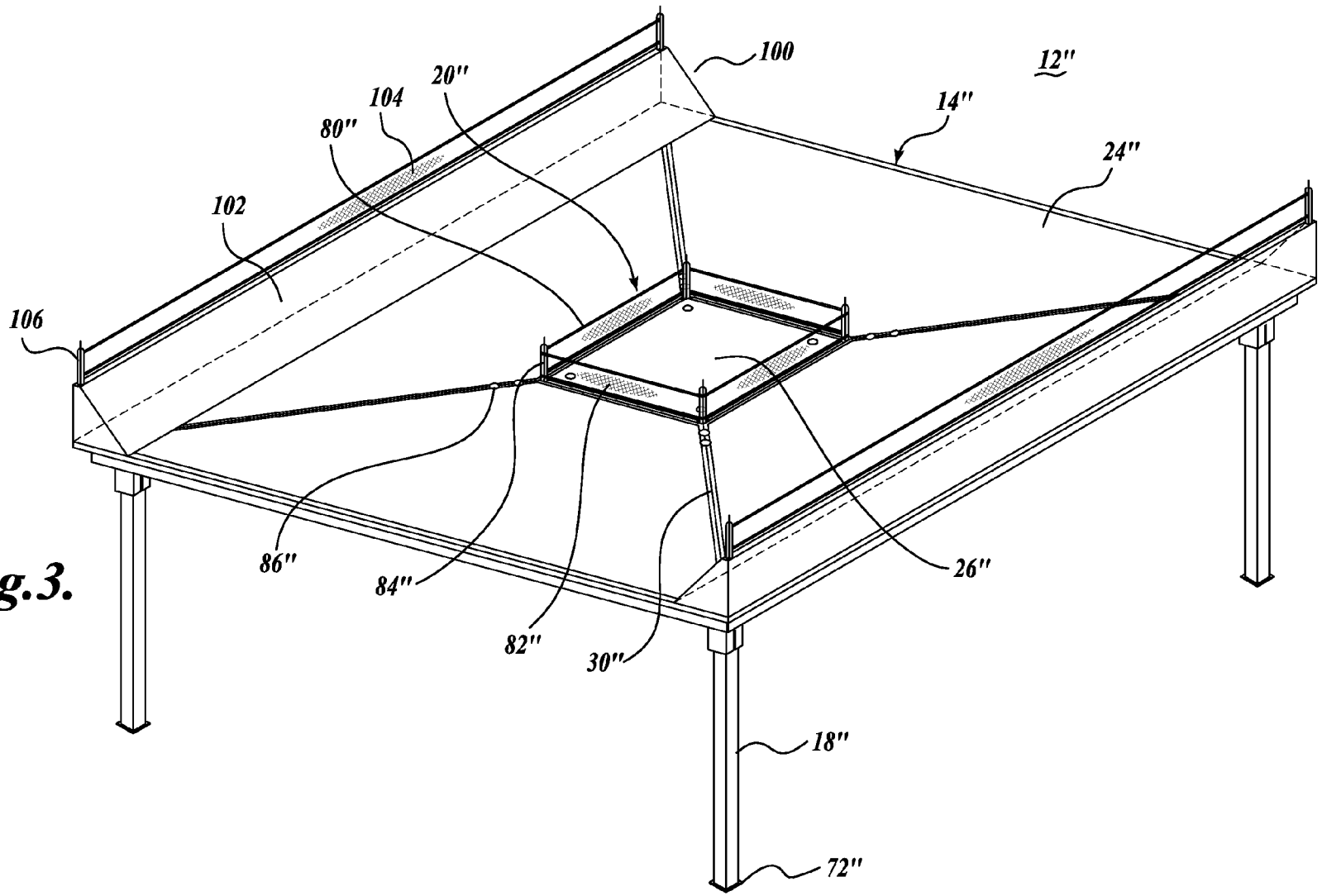
FIG. 3 is an isometric view of a third embodiment of the present disclosure.

Next, referring to FIG. 3, abutments in the form of bumpers 100 are positioned along opposite sides of game table 12". The bumpers are shown as generally triangular in cross-section with the diagonal hypotenuse 102 of the triangular shape defining a sloped abutment face that extends upwardly from the surface of the game table and diagonally outwardly toward the outer edge of the game table. This slope of the abutment face 102 tends to cause the playing ball that may hit against the face to rebound upwardly, or perhaps against a fence 104 that extends along the top of the bumper 100. The fence 104 may be composed of netting material that spans between end posts 106 that extend upwardly from the upper edge of the bumpers 100. The height of the fence 104 may be selected as desired to help retain the playing ball on the game table.

The embodiment of the game table 12" shown in FIG. 3 may be particularly helpful to players who are sitting in a wheelchair or other appliance. As can be appreciated, such players would have a more difficult time retrieving a playing ball that is hit off the game table and onto the floor. The bumpers 100 can be of other configurations than shown in FIG. 3. Moreover, the bumpers 100 could be replaced by a taller fence that extends upwardly from the top surface of the table top 14" itself.

Although the bumpers 100 are described above as triangular in shape, the bumpers instead may be composed of two sections, a vertical section extending upwardly from the outer edge of game table 14" and the sloped abutment face 102 extending from the upper edge of the vertical section down to the level of the table top 14". Moreover, the bumper 100 could be attachable to the table top by any convenient means, for example, the vertical section of the bumper can overlap the side edge of the table top 14" and be secured to the side edge, for instance, by fasteners. In this manner, the bumpers 100 could be removed when not needed.

As discussed above, the size of the table top 14 can be altered as desired. In one form of the present disclosure, the table top may be in a square shape, six feet along each side of the top. Moreover, the landing zone 20 could be 1½ feet along each of its square sides. This would leave a distance of 2¼ feet between the landing zone and the edge of the table top 14. As also noted above, the size of the landing zone 20 can be varied relative to the size of the table top 14. This of course is only one configuration and only one size of the game table 12 that is possible. As noted above, other sizes and shapes of the game table 12 are possible.

With respect to the assembly of the game table, this is conveniently accomplished by first assembling the underlying frame 16 by interconnecting the perimeter rails 34 to each other via corner brackets 36. Thereafter, the crossbeams 38 may be interconnected to the perimeter rails and then the crossbeam segments 42, 44, and 46 may be interconnected to the perimeter rails and crossbeams 38. Thereafter, the underlying frame may be attached to the underside of the table top sections 24 and 26 and then the legs 18 attached to the frame. Alternatively, the legs 18 may be attached to the frame and then the table top sections 24 and 26 placed on the frame 16 which is in standing position on legs 18. Thereafter, a center leg 18 may be positioned in place beneath the center portion of the table top 14. Next, the landing zone/bounce area 20 can be positioned on the table top 14 through the use of posts 84 that engage within socket holes 86 provided on the table top.

With respect to use of the game table to play a service-and-return game, various game rules may be employed. As one non-limiting example, a service-and-return game is played with a standard table tennis ball and paddles. With the game table configuration shown in FIG. 1, the service-and-return game can be played with either two or four players. The objective is to achieve points which are scored by the last legal hit of the game ball.

Game play is initiated by a legal serve, which is accomplished by hitting the game ball with a paddle to initially hit the player's own playing section 28 such that the game ball bounces into the landing zone/bounce area 20 and then into the opponent's playing section 28. A legal hit occurs after a legal serve, and the ball bounces up from the table and then the receiving player returns the ball into the landing zone/bounce area 20 and then into the opponent's playing section 28. The game ball must bounce up from the opponent's playing section before it can be returned by the opponent. If the opponent fails in this regard, the last player to achieve a legal hit scores a point. After serving once, the opposite player (in a two-player game) serves the ball. If there are four players, then the four players sequentially rotate service. In the above rules to score a point, service of the ball is not required, rather the point is awarded to the player that achieved the last legal hit of the game ball.

Also in the rules, if the ball touches the net or other structure used to define the perimeter boundary, the playing ball is "dead." However, if there is a legal hit or legal serve before the ball touches the net, a point is awarded. If the server touches the net with the served ball, the ball is "dead." In this situation, since there is no legal hit, no point is scored, then the next player serves the ball.

While illustrative embodiments have been illustrated and described, it will be appreciated that various changes can be made therein without departing from the spirit and scope of the invention.

The embodiments of the invention in which an exclusive property or privilege is claimed are defined as follows:

1. A game table for playing a service-and-return game with a ball, comprising:

a table top, having a top surface; and an enclosed landing zone disposed on the table top, said landing zone of an area substantially smaller than the area of the table top and defined at least in part by a perimeter boundary extending around the landing zone, said perimeter boundary extending upwardly from the top surface of the table top;

wherein, except for the landing zone perimeter boundary, the table top being substantially free of structural elements extending upwardly therefrom; and wherein the perimeter boundary of said landing zone is defined by the group consisting of a net extending along the perimeter of the boundary of the landing zone, light beams extending along the perimeter boundary of the landing zone, and a barrier extending along the perimeter boundary of the landing zone.

2. The game table of claim 1, wherein the table top is in the shape selected from the group consisting of triangular, square, rectilinear, rectangular, pentagonal, hexagonal, octagonal, round, oval, and elliptical.

3. The game table according to claim 2, wherein said landing zone is shaped to match the shape of the table top.

4. The game table according to claim 2, wherein the landing zone is located at or near the center of the table top.

5. The game table according to claim 1, wherein the table top is square in shape, and said landing zone is disposed substantially in the middle of the square-shaped table top.

6. The game table according to claim 5, wherein the table top comprises section lines extending from the corners of the table top to the landing zone, to divide the table top into four playing areas.

7. The game table according to claim 1, wherein at least one of the size and shape of the landing zone can be selectively changed.

8. A game table for playing a service-and-return game with a ball, comprising:

a table top, having a top surface; and an enclosed landing zone disposed on the table top, said landing zone of an area substantially smaller than the area of the table top and defined at least in part by a perimeter boundary extending around the landing zone, said perimeter boundary extending upwardly from the top surface of the table top;

wherein, except for the landing zone perimeter boundary, the table top being substantially free of structural elements extending upwardly therefrom; and wherein the table top is constructed in segments joined together to form a continuous top surface of the table top; with adjacent segments defining interfaces that correspond to boundaries of playing areas defined on the table top.

9. The game table according to claim 1, further comprising removable legs to support the table top at an elevation above the floor.

10. The game table according to claim 9, wherein said removable legs are positioned adjacent the edges of the table top, as well as at least one leg positioned generally centrally relative to the table top.

11. The game table according to claim 9, further comprising a frame underlying the table top to support the table top; and wherein said legs are detachably attachable to the frame.

12. The game table according to claim 11, wherein said frame comprising perimeter sections extending along the perimeter of the table top and transverse sections extending across the width of the table top.

13. The game table according to claim 12, wherein the perimeter sections and the transverse sections are assemble-able and disassemble-able relative to each other.

14. The game table according to claim 11, wherein said table top is constructed in segments that cooperatively define a continuous table top, with each of the table top segments attachably detachable to the frame.

15. A game table for playing a service-and-return game with a ball, comprising:

a table top, having a top surface; and an enclosed landing zone disposed on the table top, said landing zone of an area substantially smaller than the area of the table top and defined at least in part by a perimeter boundary extending around the landing zone, said perimeter boundary extending upwardly from the top surface of the table top;

wherein, except for the landing zone perimeter boundary, the table top being substantially free of structural elements extending upwardly therefrom;

further comprising abutments extending along opposite side edges of the table top and extending upwardly above the top surface of the table top; and wherein said abutments comprise bumpers that have a sloped abutment face extending upwardly from the table top and outwardly toward the adjacent side edges of the table top.

16. The game table according to claim 15, further comprising a fence extending along the bumpers and extending upwardly from the bumpers.

* * * * *